US006299027B1

(12) United States Patent
Berge et al.

(10) Patent No.: US 6,299,027 B1
(45) Date of Patent: Oct. 9, 2001

(54) VALVE CONTROLLED DISPENSING CLOSURE

(75) Inventors: Gary Berge, Crystal Lake; Thomas C. Stoneberg, Buffalo Grove, both of IL (US)

(73) Assignee: Courtesy Corporation, Buffalo Grove, IL (US)

( * ) Notice: Subject to any disclaimer, the term of this patent is extended or adjusted under 35 U.S.C. 154(b) by 0 days.

(21) Appl. No.: 09/640,213

(22) Filed: Aug. 16, 2000

Related U.S. Application Data

(63) Continuation-in-part of application No. 09/472,696, filed on Dec. 27, 1999.

(51) Int. Cl.[7] ..... B67D 5/378

(52) U.S. Cl. ..... 222/153.14; 222/522; 222/514

(58) Field of Search ..... 222/182, 522, 222/153.14, 514, 553, 507, 525, 508, 511, 513, 515, 524, 518, 206, 496, 499; 215/315

(56) References Cited

U.S. PATENT DOCUMENTS

| | | | | |
|---|---|---|---|---|
| 2,210,206 | | 8/1940 | Fisher . | |
| 3,338,467 | | 8/1967 | Albert . | |
| 3,561,632 | * | 2/1971 | Shirae | 215/315 |
| 4,135,513 | | 1/1979 | Arisland . | |
| 4,238,045 | | 12/1980 | D'Andria . | |
| 4,979,648 | * | 12/1990 | Montgomery et al. | 222/153 |
| 5,328,063 | | 7/1994 | Beck et al. . | |
| 5,495,966 | | 3/1996 | Won . | |
| 5,607,073 | | 3/1997 | Forrer . | |
| 5,649,645 | * | 7/1997 | Demarest et al. | 222/153.06 |
| 5,699,933 | | 12/1997 | Ho et al. . | |
| 5,799,839 | * | 9/1998 | Moran et al. | 222/522 |
| 5,850,908 | | 12/1998 | Jasek . | |
| 5,893,472 | | 4/1999 | Forrer . | |
| 5,947,345 | * | 9/1999 | Hofmann | 222/522 |
| 6,085,947 | * | 6/2000 | Lien | 222/522 |
| 6,213,351 | * | 6/2001 | Stoneberg et al. | 222/153.14 |

* cited by examiner

*Primary Examiner*—Kevin Shaver
*Assistant Examiner*—Stephanie Willatt
(74) *Attorney, Agent, or Firm*—Silverman, Cass & Singer, Ltd.

(57) ABSTRACT

A push valve dispensing closure including a base mountable to the mouth of a container, a valve mounted within the base and a cap cooperatively engaged upon the base for rotational movement of the valve relative to the base between locked and unlocked positions, and, in the unlocked position, between a first closed position and a second open position with respect to the base. The base is formed with a product dispensing channel having a wall with a generally conical-shaped cross-sectional configuration and the valve has depending spring-action circumferential flange segments formed thereon for cooperative engagement with the conical-shaped wall. The cap includes a discharge orifice closed by a panel on the valve with rotation of the cap relative to the valve, after movement of the valve to the unlocked position, opening the orifice.

11 Claims, 7 Drawing Sheets

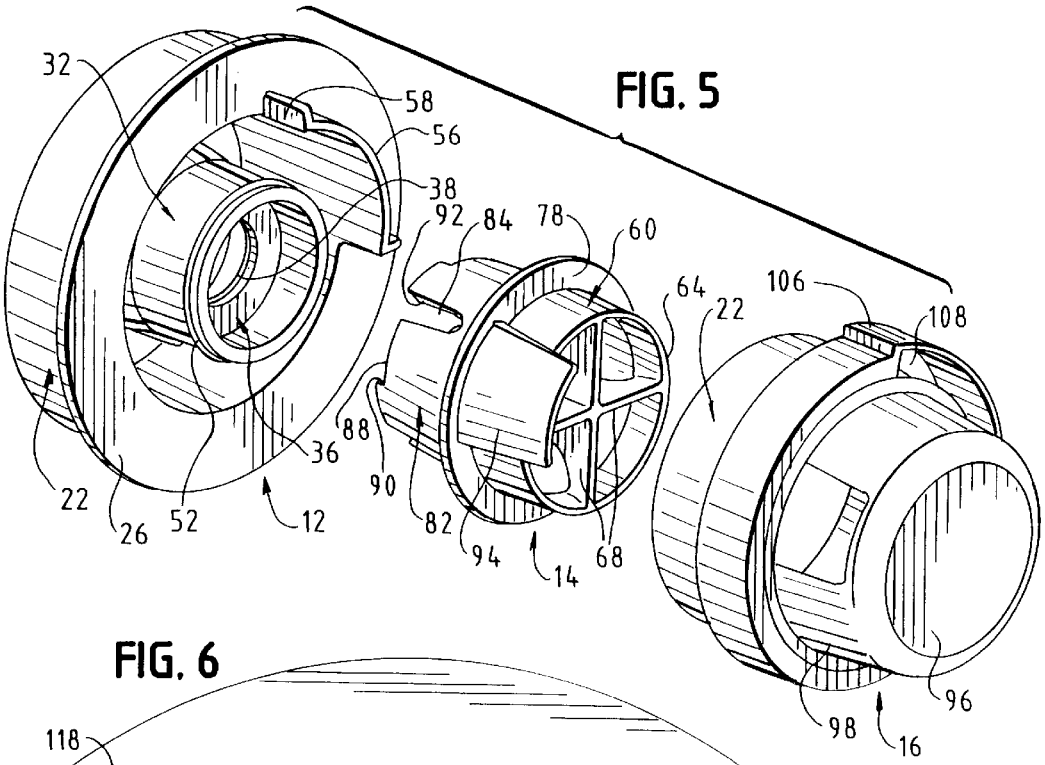
FIG. 5
FIG. 6
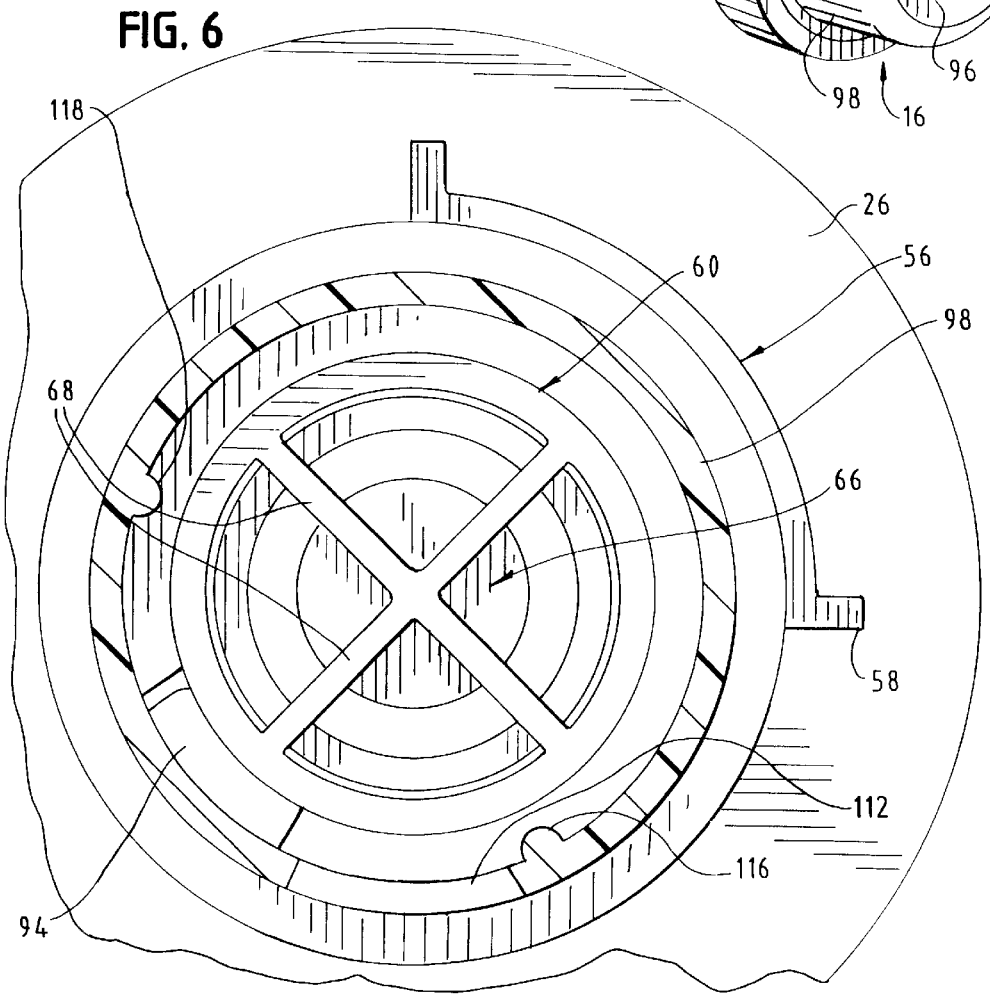

VALVE CONTROLLED DISPENSING CLOSURE

This is a continuation-in-part of application Ser. No. 09/472,696, filed Dec. 27, 1999.

BACKGROUND OF THE INVENTION

1. Field of the Invention

This invention relates generally to dispensing closures for containers, and more particularly, to such closures which, after being opened, automatically return to their closed position to prevent unintentional dispensing of product from such containers.

2. Description of the Prior Art

Push body closures are known in which a cap or spout having a dispensing aperture is positioned upon a base with cooperative elements therebetween to permit the closure to be opened or closed by disengagement or engagement of the cooperative elements. The base is affixed to the mouth of a product container, such as a water bottle. When a force is applied to the cap to move the cap with respect to the base, such as by pushing on the cap with the lips of a user, the cooperative elements between the cap and base are caused to disengage and thereby open the closure and permit the product, such as water, in the container to pass through a dispensing aperture in the cap and be dispensed into the user's mouth for drinking.

It also is known to provide structure in such closures to effect automatic closing thereof from the open condition when dispensing of the product is to be terminated. Such structure commonly includes return-engagement springs, levers or the like to cause the cooperative elements between the cap and the base to return to their engaged position when the force applied to the cap is released, thereby closing the closure and preventing unintentional further dispensing of product from the container, such as if the container were inadvertently tipped over.

The push body valve closures of the prior art generally include relatively complex and involved structure which is difficult to manufacture, such as by molding process for plastic closures, and/or includes fragile elements which are susceptible to breakage.

SUMMARY OF THE INVENTION

Basically, it is an object of the invention to provide a push body valve closure of the type described in which the components, preferably formed of molded plastic material, are relatively uncomplex in construction and allow for economies in manufacture. The proposed closure is also of a sturdy structure which is not susceptible to breakage notwithstanding repeated use.

The present invention provides a structure which accomplishes the above objectives of a push body valve closure, and additionally includes a locking feature which prevents movement of the closure cap and valve to the open position with respect to the base unless and until the valve is first moved to an unlocked position.

More specifically, the invention is characterized by a push body valve closure including a base adapted to be secured to the mouth of a container, for example a water bottle, for a product to be dispensed therefrom; a valve engaged upon the base and moveable with respect thereto between a first closed position and a second open position; and a spout-defining cap controlling operation of the valve both between the locked and unlocked position by rotation, and between the closed and open position by a push action. A product dispensing channel is formed in the base to be in communication with the container mouth, and includes an aperture through which such product may be dispensed. A portion of the wall of the channel is of generally conical-shaped cross-sectional configuration.

The valve includes a peripheral wall with a radially outwardly extending rib circumferentially thereabout at slightly above mid-height. The portion of the valve wall below the rib forms a depending circumferential flange, with four spring-action segments, engaged about the channel wall for cooperative engagement with the outer surface of the conical-shaped wall portion of the base channel. The valve also includes a depending plug centrally within the peripheral valve wall and positioned by an open spider-work which mounts the plug while allowing for free flow of the product past the plug and through the valve. The plug is positioned to be in cooperative engagement with the aperture of the product dispensing channel through the base for selective axial movement relative thereto for a selective opening and closing of the aperture.

The cap has a push-button top surface with a depending peripheral wall having an orifice formed therein. The orifice is selectively closed by a closing panel projecting upward from the valve rib in alignment with and overlying the orifice immediately inward of the cap wall with opening of the orifice being effected by a relative rotation between the cap and valve to position the valve closing panel circumferentially remote from the cap orifice.

The inner face of the cap wall, at a height adjacent the lower edge of the orifice, is provided with a circumferential groove which receives the outer peripheral edge of the radially outwardly extending rib of the valve thereby locking the valve within the cap for a longitudinal or push-pull movement therewith. The rib and groove engagement is such as to allow for a cooperating rotation of the valve with the cap, and a relative rotation of the cap relative to the valve upon engagement of the valve with a rotation-limiting abutment.

While four spring-action segments, as illustrated, are preferred, less segments or more segments may be provided. Keying slots are formed between the spring-action segments, and locking notches are formed on the spring-action segments of the circumferential flange of the valve. Keying ribs are formed on the surface of the conical-shaped wall portion of the base channel for cooperative engagement with the notches to retain the valve in its locked position and prevent unintentional movement of the valve to its unlocked position unless and until the valve, by rotation of the cap, is rotated on the base. Indicia can be applied to the external surface of the cap and base to visually indicate when the cap has positioned the valve in its locked/unlocked position.

In use, and with the valve in its unlocked position with the orifice open, engagement of a force against the cap, such as by the lips or a finger of a user, moves the cap to an open position with respect to the base wherein the plug is withdrawn inwardly from the aperture and the depending spring-action circumferential flange segments are engaged against the conical-shaped wall portion of the channel. In such opened position, product retained in the container may be dispensed through the aperture in the channel, through the valve passage and out of the orifice in the cap. The valve remains in its opened position with respect to the base so long as the force continues to be applied against the cap to resist the spring-action of the circumferential flange segments of the valve against the conical-shaped wall of the channel which biases the cap back to its closed position.

Upon disengagement of the force against the cap, the spring-action of the circumferential flange segments of the valve act against the conical-shaped wall of the channel to cause the valve and cap to be directed back to their closed position in which the plug is engaged within the aperture of the channel, thereby preventing further dispensing of product from the container unless and until a force is reapplied against the cap.

A further feature of the invention is the provision of means for preventing an unintentional initial opening of the dispensing closure. This basically involves a tamper-evident means for ensuring to the purchaser of a commercial product that the container has not been opened prior to purchase, or the contents thereof accessed or dispensed through manipulation of the valve assembly. Pursuant to this end, the base includes a vertically extending and circumferentially elongate anti-rotation rib thereon in outwardly spaced relation to the channel-forming wall. This rib is, upon an assembly of the apparatus, received within a complementary anti-rotational opening formed about the periphery of the cap. The opening is defined by a frangible strip which is outwardly spaced from the cap wall a sufficient distance as to receive the anti-rotation rib of the base with the opposed ends of the frangible strip sealed, as for example by being integrally molded with the cap wall, to provide for an outwardly offsetting of the frangible strip to define the opening. The opening is of a size so as to snugly receive the anti-rotation rib and, in normal use, preclude relative rotation therebetween. However, the frangible nature of the strip is such so as to allow for an intentional breaking away of the strip, either by direct manual engagement therewith, or by a forcible rotation of the cap relative to the base, thus freeing the cap for operation of the valve apparatus in the manner described. The frangible strip, in addition to preventing accidental opening of a sealed container, provides ready visible evidence of such an opening.

Various objects and advantages of the invention will become apparent in accordance with the above and ensuing disclosure in which a preferred embodiment is described in detail in the specification and illustrated in the accompanying drawings. It is contemplated that minor variations may occur to persons skilled in the art without departing from the scope or sacrificing any of the advantages, of the invention.

BRIEF DESCRIPTION OF THE DRAWINGS

FIG. 5 is an exploded perspective view of the three components of the closure;

FIG. 6 is a sectional view taken along line 6—6 of FIG. 3, in the direction indicated generally;

DESCRIPTION OF PREFERRED EMBODIMENTS

Figure 9:
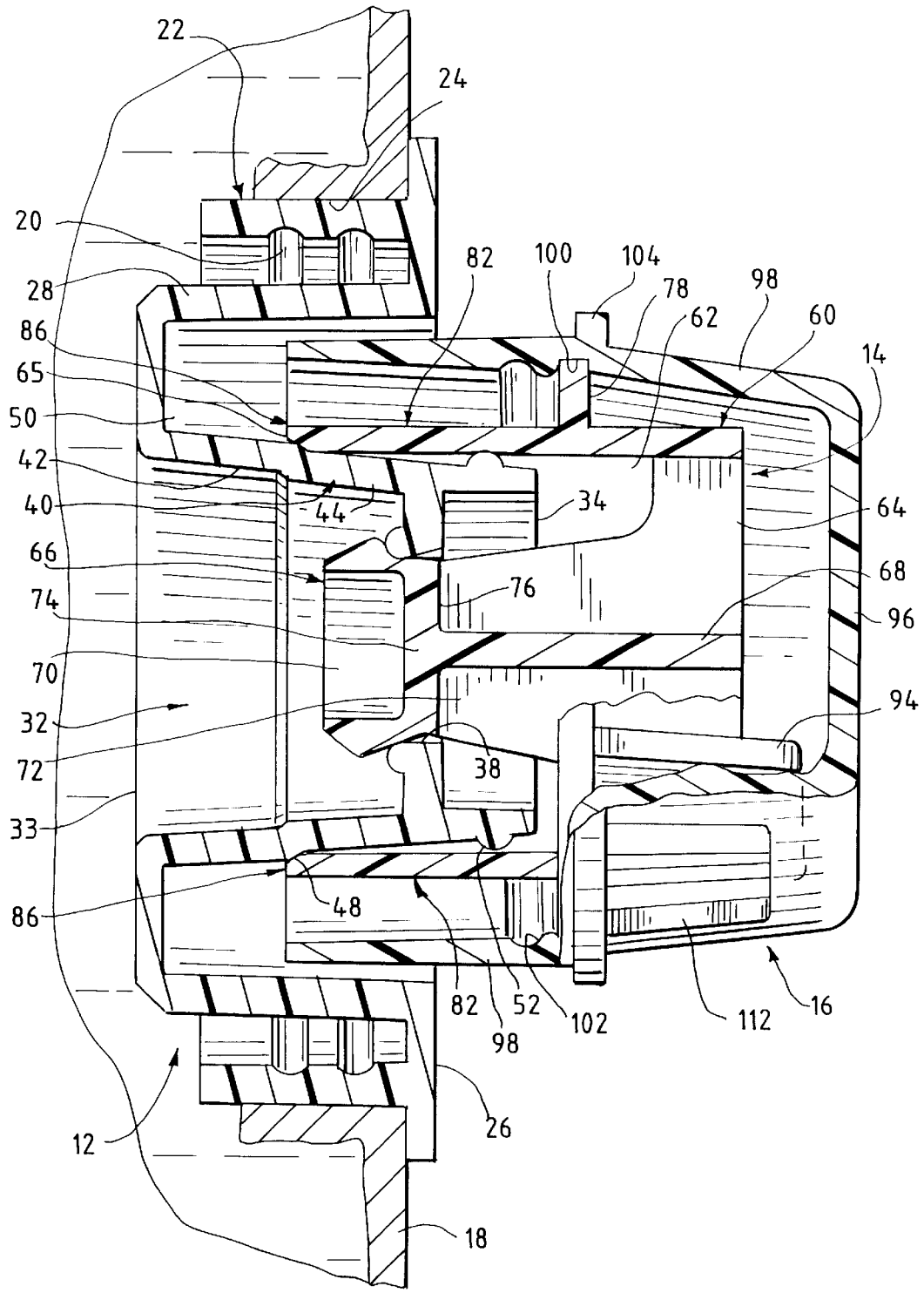
FIG. 9 is a sectional view taken along the line 9—9 of FIG. 2, in the direction indicated generally.
Figure 10:
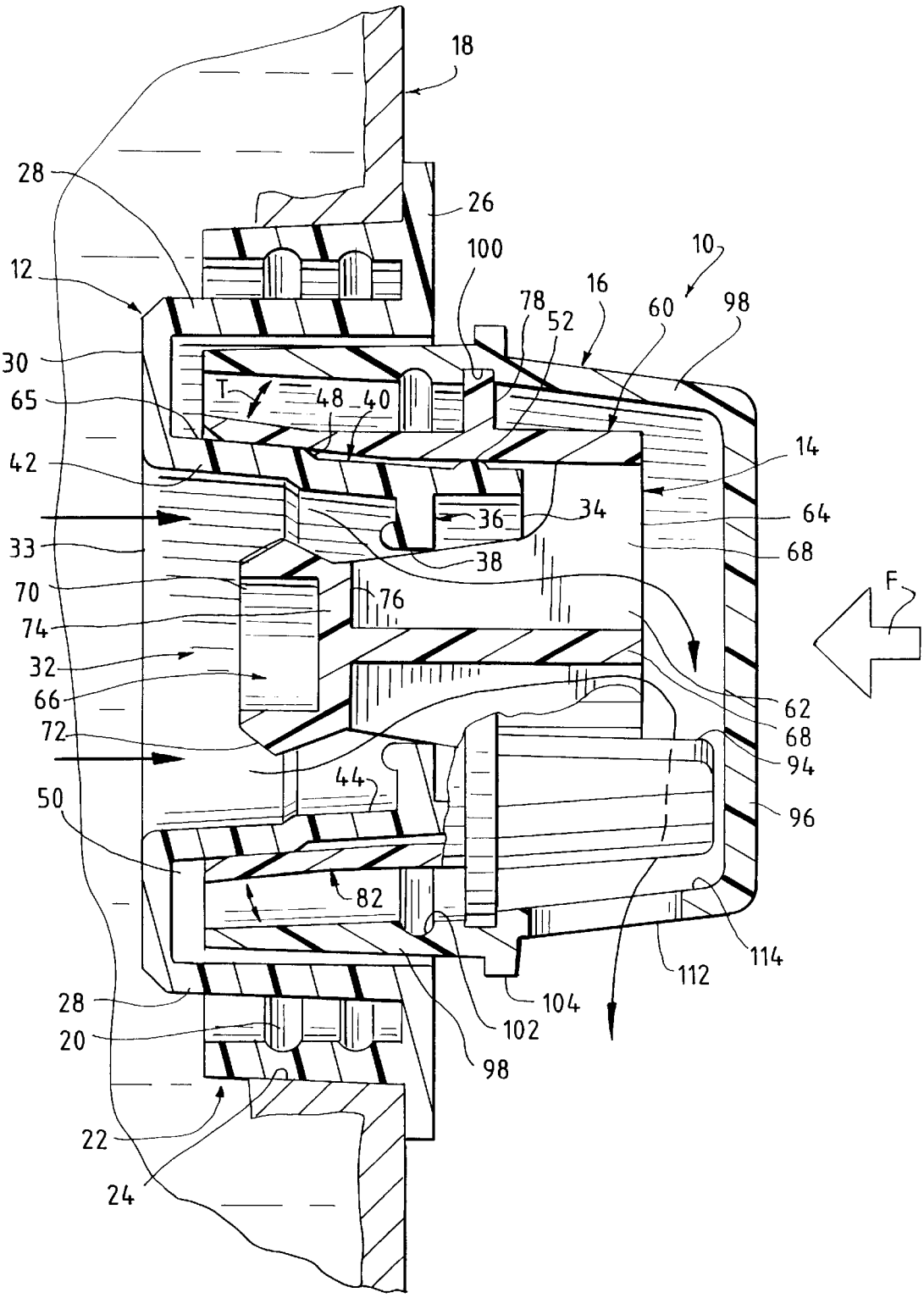
FIG. 10 is a sectional view taken along the line 10—10 of FIG. 4, in the direction indicated generally.

Referring to the drawings, the dispensing closure 10 of the invention, preferably formed of molded plastic material, includes three cooperating components, base 12, valve 14 engaged upon the base 12, and cap 16 overlying valve 14 for manipulation of valve 14 relative to base 12. The base 12 is adapted for attachment to the mouth of a container 18 in a known manner, such as by screw threads 20 formed on the inner surface of a depending outer skirt 22 of base 12 which mate with like threads on the mouth of the container. Alternatively, and as illustrated in FIGS. 9 and 10, the base skirt 22 can be pressure-fit within a smooth-bore container opening 24.

Base 12 includes an annular flange 26 overlying and extending radially beyond the base skirt 22 for, as may be required, engagement with the body of the container about the opening therein. This flange 26 also projects radially inward of the skirt 22 and terminates at an integral depending inner skirt 28 generally parallel to and inwardly spaced from the outer skirt 22 for the accommodation of a container neck or the like, and again depending upon the particular nature of the container opening.

The inner skirt 28 depends below the outer threaded skirt 22 and terminates in an annular base closure wall 30 extending generally normal to the inner skirt and radially inward therefrom to an elongate dispensing channel 32 formed upon the base closure wall 30 integral with and completely about the annular inner periphery thereof. Channel 32 includes an open lower end 33 communicating directly with the interior of the container 18 upon a mounting of the closure thereto. The elongate dispensing channel 32 also includes an upper or second terminal end 34 spaced from the lower open end 33 and closure wall 30. A platform 36 is formed within dispensing channel 32 at a location between said first lower end 33 and said second upper end 34 thereof, with an aperture 38 provided within and through platform 36 to permit product which is introduced into the channel 30 to be dispensed through the aperture 38.

The wall 40 of elongate dispensing channel 32 is formed with a first lower portion 42 disposed proximate to first end 33. Wall portion 42 is of generally conical-shaped cross-sectional configuration. Wall 40 also includes a second upper portion 44 slightly inwardly offset from wall portion 42 and either of a similar conical configuration or of a generally cylindrical-shaped cross-sectional configuration extending from the first portion 42 to said second terminal end 34 of channel 30. The two wall portions 42, 44 are joined together and define an outwardly directed shoulder 48 that provides a resting surface (see FIG. 9) for a purpose to be described hereinafter. The inner skirt 28, as illustrated, is spaced from the conical-shaped wall portion 42 and defines an upwardly opening generally U-shaped channel 50 upon base 12.

The channel wall 40, immediately below the upper end thereof, is provided with an annular sealing bead 52 formed on the outer surface thereof and completely thereabout. The outer surface of the lower conically shaped portion 42 of the wall 40 is provided with multiple, preferably four, keying ribs 54 vertically there along at equally spaced points thereabout. Finally, an elongate arcuate anti-rotation rib 56 extends upwardly from the annular base flange 26 along a portion of the inner peripheral edge thereof. This rib 56, as desired, may include short radially outwardly directed ends 58 terminating well short of the outer peripheral edge of the flange 26. The function or purposes of these various components will become apparent from descriptions following hereinafter.

Valve 14 includes an external generally cylindrical wall 60 forming a through-passage 62 opening at axially aligned opposed upper and lower ends 64 and 65.

A closure plug 66 is positioned within valve through-passage 62 and depends from an area proximate to, and in registry with, open upper passage end 64 by mounting spokes 68 forming an open support spider. Plug 66 includes a generally cylindrical-shaped body portion 70 with an external bulging wall surface 72 and a circular platform 74 formed across one end 76 of cylindrical body portion 70 to close same. Mounting spokes 68 extend from platform 74 of plug 66 to the internal surface of the valve wall 60.

An annular retaining rib 78 is formed peripherally about the valve wall 60 and extends radially outward therefrom at a point slightly above mid-height on the wall 60. That portion of the wall 60 below the rib 78 defines a flange 80 for automatically closing the valve apparatus. The actual closing action or bias is achieved by multiple depending spring-action flange segments 82 with vertical keying slots 84 between and defining the flange segments 82. These keying slots 84 correspond in number and positioning to the keying ribs 54 on the base.

Figure 7:
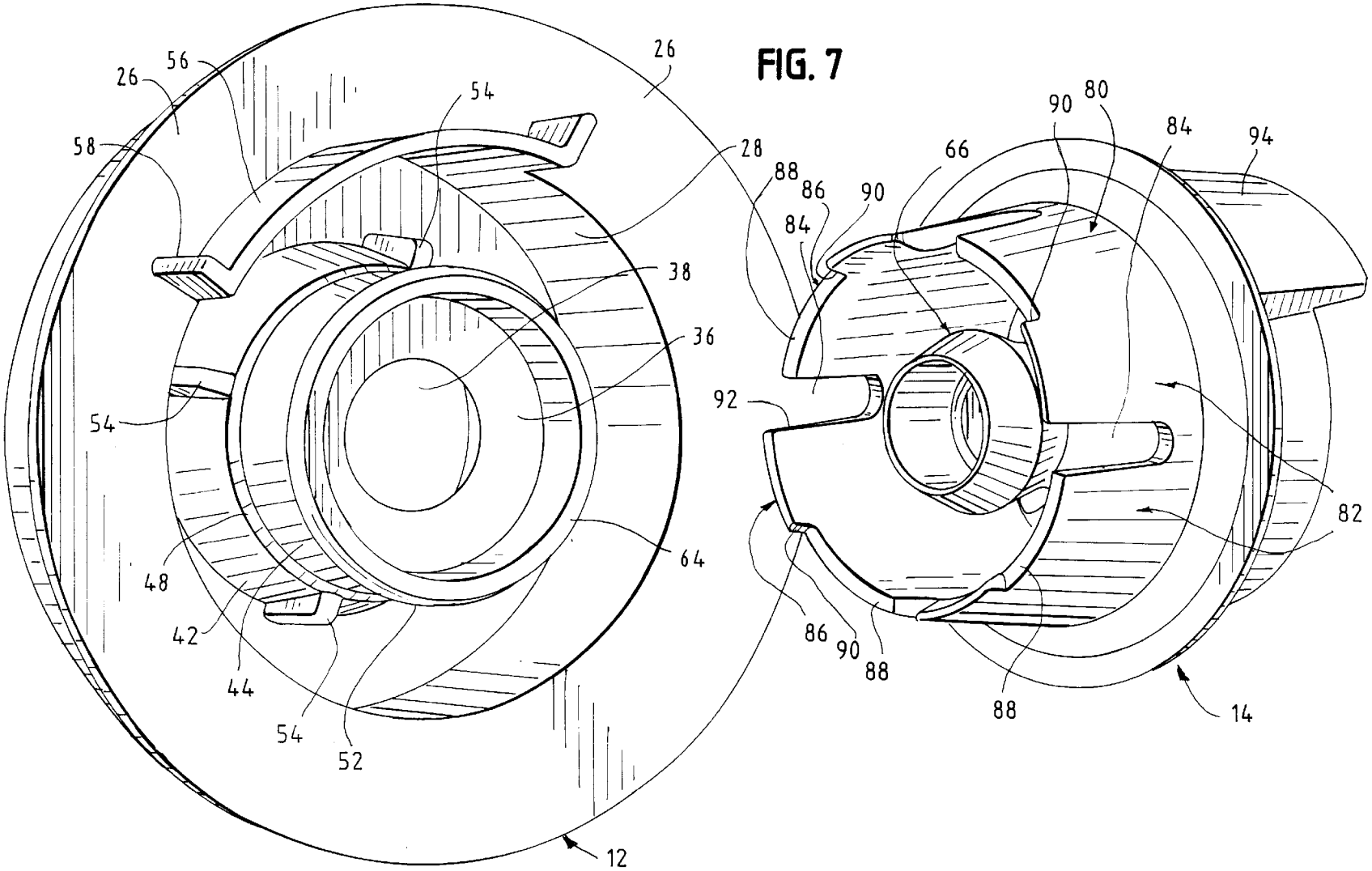
FIG. 7 is an enlarged exploded perspective view detailing the interior of the base and the lower portion of the valve.

Noting FIG. 7 in particular, the terminal or free edge 86 of each flange segment 82, adjacent a corresponding keying slot 84, is formed with a locking notch 88, the notches 88 extending in a common circumferential direction for slightly more than one-half the length of the corresponding terminal edges 86 and terminating in respective abutment surfaces 90. Each flange segment 82 is provided with a second abutment or stop surface 92 circumferentially spaced from the first abutment surface 90 and defined by that unnotched edge portion of the flange segment which is opposed from the first abutment 90 and aligned with the keying slot 84 of the rotationally adjacent flange segment 82. As will be appreciated from the bottom view of the terminal edge portions of the flange segments 82 in FIG. 7, the notches and abutments on the segments are duplicates of each other and positioned for simultaneous cooperative engagement with the keying ribs 54 on the base with each notch 88 extending in a clockwise direction from the corresponding keying slot 84.

The valve 14 further includes an orifice closing panel 94 integrally formed with the annular rib 78 about the valve wall 60 and extending along a portion of the circumference thereof. This panel 94 has an outer surface outwardly spaced from the corresponding upper portion of the valve wall 60 and slightly inclines inward thereto upward from the rib 78, terminating in spaced relation above the open upper end 64 of the valve passage.

As seen in FIG. 9, valve 14 is adapted to be positioned upon base 12 in the closed disposition of closure 10 with closure plug 66 in cooperative engagement with aperture 38. The initial assembly of the valve to the base will include a forcible engagement of the plug 66 through aperture 38. In such disposition, the circumferential wall of aperture 38 functions as a seat for plug 66 against which bulging wall surface 72 upwardly engages to seal aperture 38. Also, in such disposition, spring-action circumferential flange segments 80 rest upon resting surface or shoulder 48. In this closed position of valve 14 with respect to base 12, product is prevented from passing through dispensing channel 32 and out through valve passage 62.

The actual manipulation of the valve 14 between locked and unlocked positions, and between open and closed positions, is effected by the separately formed cap or cover 16 which includes a top push panel 96 with a depending generally cylindrical annular wall 98 of a diameter for telescopic reception over the valve 14 in outwardly spaced relation to the wall 60 thereof and for free sliding reception within the skirt 28 of the base 12. The cap wall 98 has an annular groove 100 formed in the inner face thereof at approximately mid-height and frictionally receives and retains the outer peripheral edge of the annular valve rib 78 therein. The engagement of the valve rib 78 within the cap groove 100 is such as to provide sufficient frictional resistance to relative movement therebetween as to allow for rotational manipulation of the valve 14 with the cap 16 until such time as rotation of the valve is specifically precluded by engagement against appropriate abutment means as shall be described subsequently. As desired, and noting FIGS. 9 and 10, an auxiliary groove 102, substantially duplicating the groove 100, can be provided in slightly spaced relation there below should dimensional variations in the height of the components require an alternate positioning of the cap relative to the valve and base.

Figure 8:
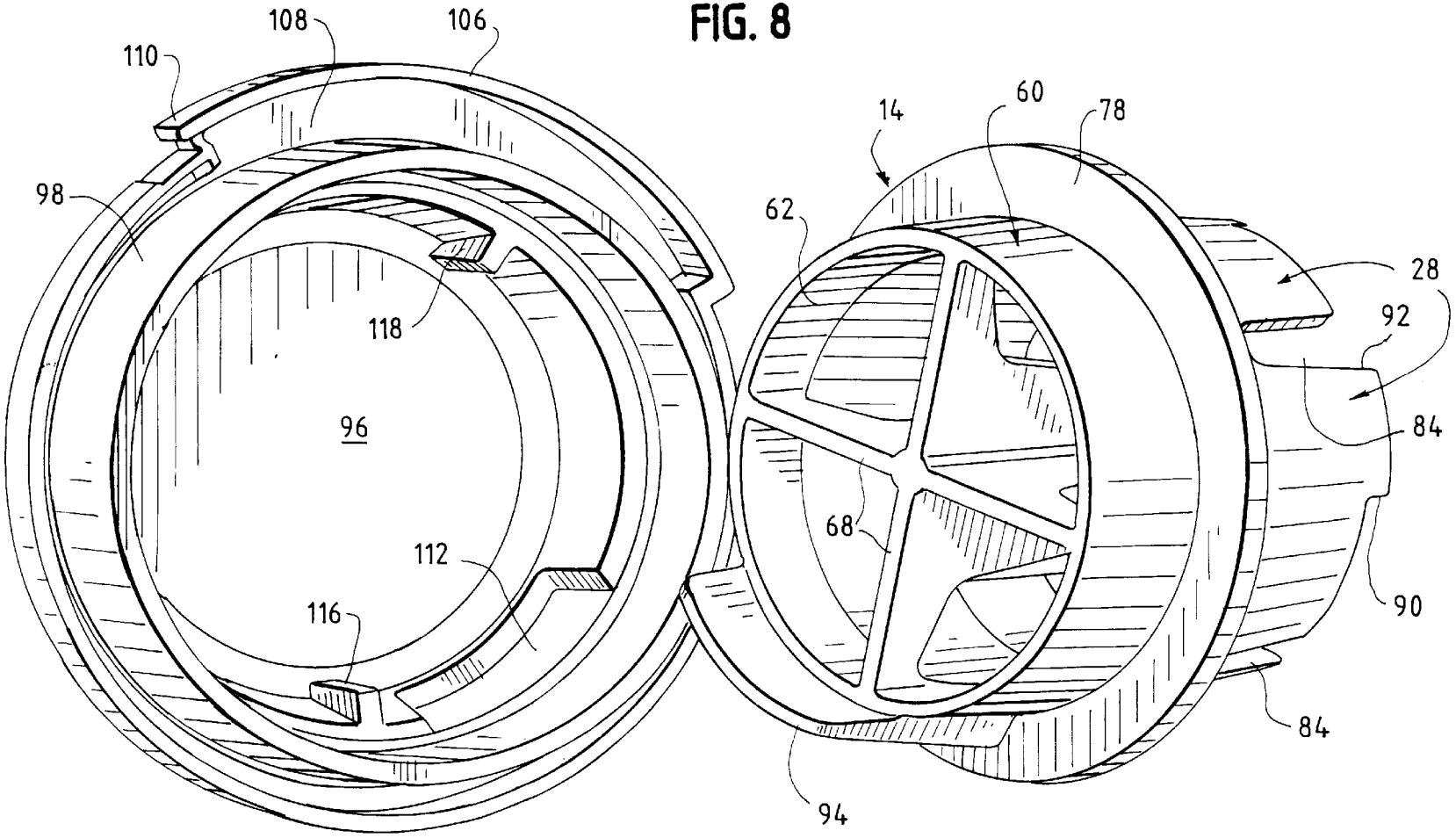
FIG. 8 is an exploded perspective view detailing the interior of the cap and the upper portion of the valve.

The cap wall 98, in general alignment with the groove 100, includes an integral outwardly extending band 104 about the exterior thereof. Noting FIGS. 1 and 8 in particular, a section 106 of the band 104 is outwardly offset from the cap wall 98 and defines an anti-rotation opening 108. This opening 108 receives the anti-rotation rib 56 on the flange 26 of the base 12, upon a mounting of the cap over the valve and within the base channel 50, with the relationship between the rib 56 and opening 108 being such as to preclude accidental rotation of the cap, and hence valve, relative to the base. The strip 106 is frangible and capable of controlled breaking away to allow for free movement of the anti-rotation rib 56 relative to the cover. The breaking away of the band strip 106 can be achieved by a direct manual pull thereon, note for example the end lip 110 illustrated on the strip in FIG. 8, or by the application of a positive forceful rotation of the cap relative to the base whereby the strip is subjected to a breaking force by the anti-rotation rib 56. Basically, the anti-rotation components form a tamper-evident seal which ensures the integrity of the container and the product when purchased.

The cap 16 acts in the manner of a discharge nozzle or spout with a discharge orifice 112 being defined through the side wall 98 of the cap above the anti-rotation band 104. The size of the orifice 112 is such as to be completely closed by the valve mounted orifice closing panel 94 upon alignment therewith with the tapered exterior face of the closure panel conforming to the slightly conical inner surface of the cap wall 114 so as to seal there against in surrounding relation to the discharge orifice 112.

The cap 16 further includes a pair of inwardly projecting abutments 116 and 118. The abutment 116 is positioned closely adjacent one vertical edge of the cap orifice 112 and in rotational alignment with a first edge of the orifice closing panel 94 whereby engagement of the orifice closing panel 94 against abutment 116, positions the panel 94 in overlying sealing relation to the orifice 112 to preclude discharge therethrough. The second abutment 118 is circumferentially remote from the opposite edge of the orifice 112 a distance whereby, upon engagement of the orifice closing panel 94 therewith, the panel 94 is completely withdrawn from the orifice 112.

Figure 1:
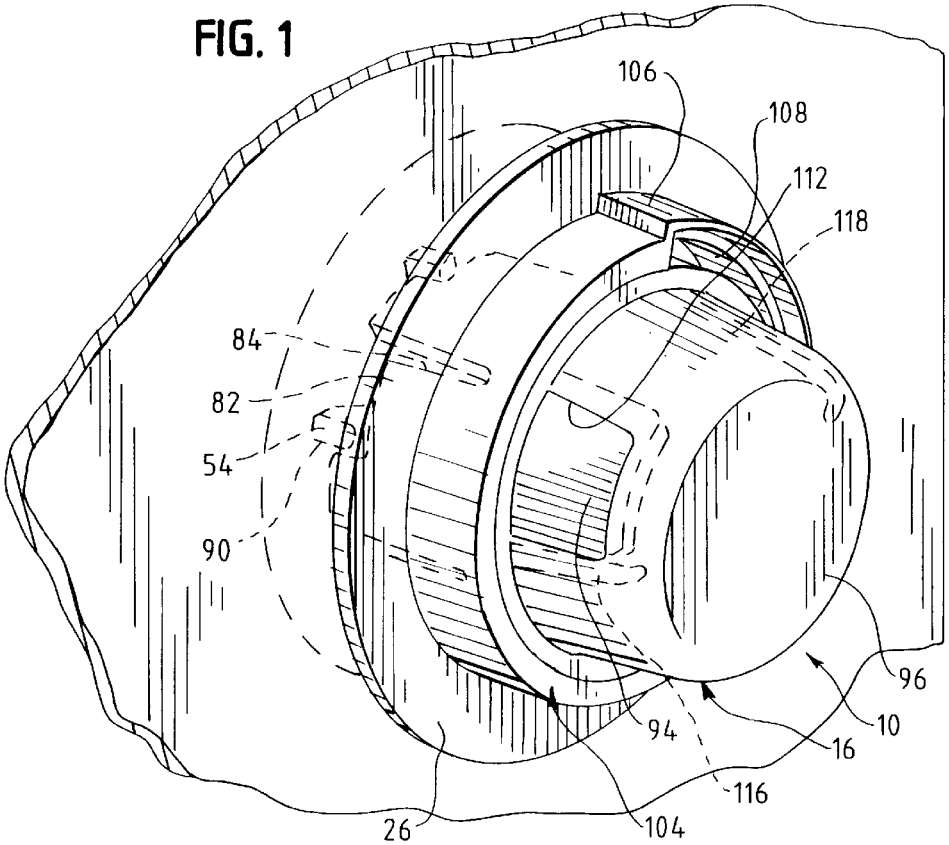
FIG. 1 is a perspective view, with various positioning components shown in phantom lines, of the push body valve closure of the invention, the same being shown with the cap and valve in closed and locked position with respect to the base.

Referring now more specifically to the manner in which the dispensing closure operates, attention is initially directed to FIG. 1 which illustrates the closure in its closed and locked position with the tamper-evident components intact. As noted in phantom lines, in this position, the keying ribs 54 on the base are engaged against the abutment ends 90 on the flange segments 82 of the valve. The keying ribs 54 are thus remote from the keying slots 84, thus precluding a push action on the valve 14 whereby the plug 66, noting FIG. 9, is locked in its sealed position with the base aperture 38. So positioned, it will also be noted that the orifice closing panel on the valve 14 is edge engaged with the abutment 116 adjacent the cap orifice 112 whereby the panel 94 is positioned to overlie and seal the aperture 112.

Figure 2:
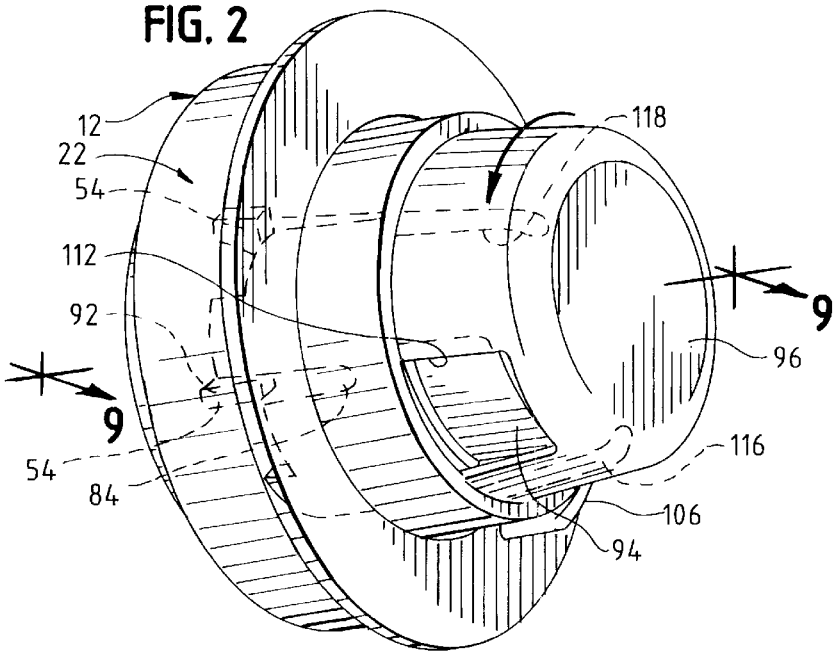
FIG. 2 is a perspective view similar to that of FIG. 1, with the valve in the unlocked position and with the anti-rotation tear strip or band removed.

Noting FIG. 2, when the closure is to be unlocked, the cap 16, along with the valve 14 frictionally locked thereto, is rotated, counterclockwise in the illustrated example, until the keying tabs 54 are brought into engagement with the second abutments 92 aligned with the keying slots 84. Prior to this rotational movement of the cap and valve relative to the base, it will also be appreciated that a removal of the tamper-evident means will be required.

Figure 3:
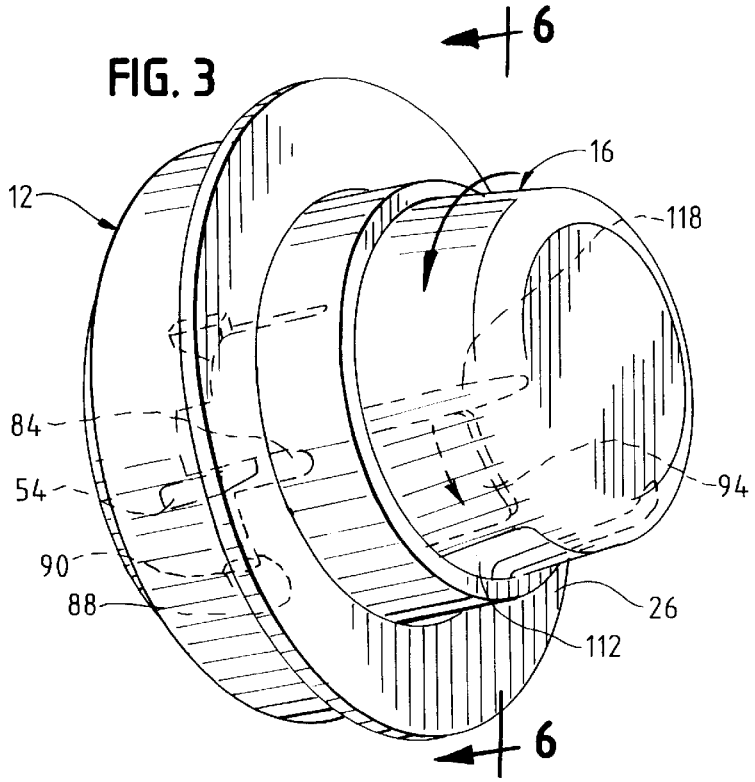
FIG. 3 is a perspective view similar to that of FIG. 2, but with the cap shown with the orifice open.
Figure 4:
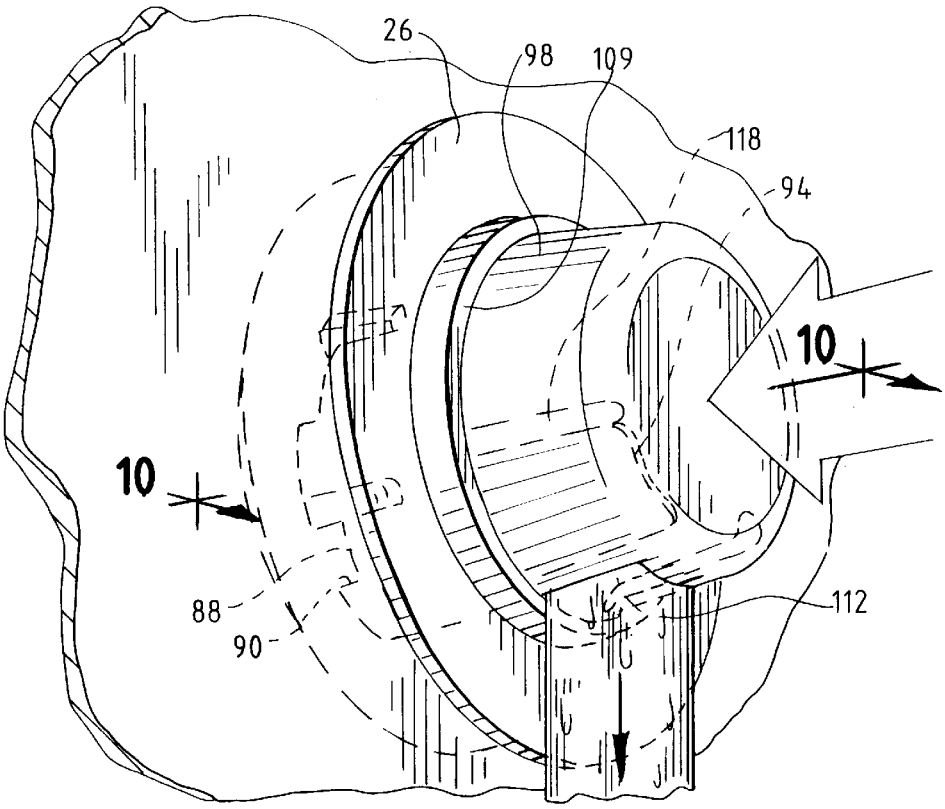
FIG. 4 is a perspective view similar to that of FIG. 3, with the cap and valve pushed inward relative to the base to open the valve.

With engagement of the keying tabs 54 against abutments 92 and in alignment with the slots 84, further rotational movement of the valve with the cap is precluded. While the valve is now positioned for a product discharging manipulation as suggested in FIG. 10, the orifice closing panel 94 continues to seal the orifice 112 in the cap 16. In order to open the orifice 112, the user will continue to rotate the cap 16, which now moves relative to the abutment secured valve. This rotation continues, noting FIG. 3, until the panel 94 engages against the cover stop abutment 118 located sufficiently remote from the orifice 112 as to allow for a complete retraction of the panel 94 therefrom. The closure assembly is now positioned, as illustrated in FIGS. 4 and 10, for a dispensing of the product.

In order to open the valve assembly, it is necessary to move the sealing plug 66 downwardly or inwardly away from the aperture 38 in the base, note a comparison of FIGS. 9 and 10. With the valve in the unlocked position and the cap orifice open, and as seen in FIGS. 4 and 10, application of a force F against the cap 16, by finger pressure or the like, moves the cap, and valve therewith, inward relative to the base, resulting in an inward shifting of the valve plug 66 away from the base aperture 38, thereby permitting product to pass through the base aperture 38, the valve passage 62, and out through the cap orifice 112.

When force F is applied to cap 16 and valve 14, depending spring-action circumferential flange segments 82 are moved off of resting surface or shoulder 48 and engage against conical-shaped wall portion 42 of channel 32 in cam-like action (FIG. 10). The spring-action flange segments 82 are maintained in tensioned engagement with wall portion 42, as indicated by arrows T in FIG. 10, so long as force F is continued to be applied to cap 16. Upon release of force F, the spring-action of flange segments 82 against conical-shaped wall 42 causes the valve 14 and cap 16 therewith automatically to be directed or cammed back to the closed position with respect to base 12 (FIG. 9).

When valve 14 and cap 16 are in open position with respect to base 12, cap wall 98 and concentric flange segments 82 are disposed within U-shaped channel 50 to prevent product contamination from being returned to the container through closure 10. Additionally, terminal end 34 of dispensing channel 32 has the spill back seal bead 52 engaged against the interior of valve wall 60 to prevent product contamination when the closure is in its opened disposition.

With valve 14 in closed position upon release of force F, cap 16 and valve 14 can be rotated on base 12 to locked position seen in FIG. 1. When so rotated, keying ribs 54 engage against abutment surfaces 90 of locking notches 88 and cap 16 cannot be depressed to open valve 16 because of engagement of the keying ribs within the locking notches.

Indicia such as arrows on the external surface of base and open/closed indicia on the external surface of the cap can be provided to visually indicate when the closure is in its unlocked ready to open position and in its closed and locked position.

The closure 10 is such that it remains in its open position to permit dispensing of product therethrough only so long as force F is applied to cap 16. Upon release of the force F, the cap and valve automatically are returned to closed position to prevent unintentional further dispensing of product, such as if the container to which the closure is applied inadvertently is tipped over.

Other configurations and variations in the structure, arrangement and size of the various parts may occur to those skilled in the art without department from the spirit or circumventing the scope of the invention as set forth in the appended claim.

What is claimed is:

1. A dispensing closure comprising, a base adapted to be secured to the mouth of a container for product to be dispensed therefrom, a valve engaged upon the base and movable with respect thereto between a first closed position and a second open position, a product dispensing channel formed in the base for communication with the container mouth, said channel having an aperture therein through which the product may be dispensed, said channel having a wall and a portion of the wall being of generally conical-shaped cross-sectional configuration, said valve including spring-action circumferential flange means for cooperative engagement with the conical-shaped wall portion of the channel, the valve having a through-passage formed therein in alignment with said channel for product discharge therethrough from said channel to the exterior of the closure, and a dispensing plug secured to the valve at a location which is in registry with the through-passage, said plug being positioned to be in cooperative engagement with the channel aperture in the base when the valve is disposed in said first closed position with respect to said base to preclude product discharge, said closure including cooperative means between said valve and base to lock and unlock same and thereby prevent the valve from inadvertently being moved between its first closed position and its second open position, said closure including an externally manipulable cap overlying the valve, cooperating means on the cap and valve for retaining the cap on the valve for movement of the valve between the closed and open positions, and to lock and unlock the valve and base relative to each other, upon manipulation of the cap.

2. A closure as claimed in claim 1 wherein said cap includes a depending peripheral wall surrounding said valve in outwardly spaced relation to the wall of said valve channel, said cooperating means on said cap and said valve including an outwardly extending rib on said channel wall having an outer peripheral edge portion, and a cooperating annular groove in said cap wall receiving said peripheral edge portion of said channel wall rib, said peripheral edge portion being retained in said groove under sufficient frictional force as to allow for rotation of said valve with said cap in the absence of a positive retention of said valve against rotation with said cap, and abutment means on the base engaging the valve upon rotation thereof by said cap upon movement of said valve into said second open position, whereby engagement of the valve with the abutment means retains the valve for rotation of the cap relative thereto.

3. A closure as claimed in claim 2 wherein said cap has a product-discharge orifice therein, said valve having a closure panel overlying said cap orifice, said cap, in the open position of the valve, being rotatable relative to the abutment retained valve for a rotational removal of the cap orifice from the closure panel on the valve.

4. A closure as claimed in claim 3 including cooperating tamper-evident means on said base and said cap for indication of a rotation of said cap relative to said base.

5. A dispensing closure for a container adapted to retain product to be dispensed therefrom, said closure comprising, a base adapted to be secured to the mouth of the container, a valve engaged upon the base and movable with respect thereto between a first closed position and a second open position, and a cap engaged on said valve for both movement of the valve and for movement relative to the value, a product dispensing channel formed in the base for communication with the container mouth, said channel having an aperture therein through which the product may be dispensed, said channel having a wall and a portion of the wall being of generally conical-shaped cross-sectional configuration, said valve including spring-action circumferential flange means for cooperative engagement with the conical-shaped wall portion of the channel, the cap having an orifice formed therein opening to the external surface of the cap, a depending plug secured to the valve and being positioned in cooperative engagement with the aperture when the valve is disposed in said first closed position with respect to said base, said plug precluding product dispensing through said aperture to said cap orifice.

6. The combination as defined in claim 5, in which said plug is withdrawn from engagement with said aperture when the valve is moved to its second open position upon application of a force against said cap, and said spring-action circumferential flange means is engaged upon said conical-shaped wall portion in tensioned engagement therewith when said valve is in said second open position.

7. The combination as claimed in claim 6 in which the spring-action flange means automatically moves along the conical-shaped wall portion upon removal of the force against the cap to cause the valve to return to its first closed position.

8. The combination of claimed in claim 5 in which the channel includes a shoulder defined in said wall immediately above said wall portion of generally conical-shaped cross-sectional configuration, said shoulder receiving said spring-action circumferential flange means when said valve is in its first closed position.

9. The combination as claimed in claim 5 including cooperative means between said valve and base to lock and unlock same and thereby prevent the valve from inadvertently being moved between its first closed position and its second open position.

10. The combination as claimed in claim 9 wherein said cap includes a depending peripheral wall surrounding said valve in outwardly spaced relation thereto, said cooperating means on said cap and said valve including an outwardly extending rib on said valve having an outer peripheral edge portion, and a cooperating annular groove in said cap wall receiving said peripheral edge portion, said peripheral edge portion being retained in said groove under sufficient frictional force as to allow for rotation of said valve with said cap in the absence of a positive retention of said valve against rotation with said cap, and abutment means on the base engaging the valve upon rotation thereof by said cap upon movement of said valve into said second open position, whereby engagement of the valve with the abutment means retains the valve for rotation of the cap relative thereto.

11. The combination as claimed in claim 10 wherein said cap has a product-discharge orifice therein, said valve having a closure panel overlying said cap orifice, said cap, in the open position of the valve, being rotatable relative to the abutment retained valve for a rotational removal of the cap orifice from the closure panel on the valve.

* * * * *